US008188353B2

(12) United States Patent
Glass

(10) Patent No.: US 8,188,353 B2
(45) Date of Patent: May 29, 2012

(54) GUITAR SOUND HOLE GUARD AND METHODOLOGY OF APPLICATION

(76) Inventor: Robert Michael Glass, Sparks, NV (US)

( * ) Notice: Subject to any disclaimer, the term of this patent is extended or adjusted under 35 U.S.C. 154(b) by 0 days.

(21) Appl. No.: 13/168,256

(22) Filed: Jun. 24, 2011

(65) Prior Publication Data

US 2011/0314994 A1 Dec. 29, 2011

Related U.S. Application Data

(60) Provisional application No. 61/398,441, filed on Jun. 25, 2010.

(51) Int. Cl.
*G10D 3/00* (2006.01)

(52) U.S. Cl. ..... 84/291

(58) Field of Classification Search ..... 84/294, 84/267, 270, 291, 290, 292
See application file for complete search history.

(56) References Cited

U.S. PATENT DOCUMENTS 7,074,992 B2 * 7/2006 Schmidt ..... 84/294

* cited by examiner

*Primary Examiner* — Kimberly Lockett
(74) *Attorney, Agent, or Firm* — John D. Long, Esq.

(57) ABSTRACT

A guitar sound hole guard comprising of a body of a suitable durable material to resist pick impacts and having a lip and at least one flange; the lip further having two side edges; each flange connects to a respective side edge to be oriented perpendicular to the lip and descending away from the lip, an open channel being formed by the lip and flange; an attachment means to hold the guard in place upon a soundboard of a guitar, wherein the body receives within its open channel at least a portion of a lower sound hole edge of the sound board allowing the lip to rest upon and conform concentrically to at least the portion of the lower sound hole edge.

20 Claims, 9 Drawing Sheets

GUITAR SOUND HOLE GUARD AND METHODOLOGY OF APPLICATION

CROSS-REFERENCES TO RELATED APPLICATION(S)

This application claims the benefit under 35 U.S.C. §119 (e) of U.S. Provisional Patent Application No. 61/398,441, filed on Jun. 25, 2010, the contents of which are relied upon and incorporated by reference.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention relates to protective devices for sound holes of plucked stringed instruments.

BACKGROUND

An acoustic guitar is generally seen as a refined musical instrument comprised generally of a neck connected at an end of a sound box to generally support a set of strings, the guitar being designed to substantially release the kinetic energy transmitted by strings during operation to transform some of that energy into audible, controllable sound. To accomplish this capability, the strings may be placed into adjustable tension in parallel orientation across a sound hole generally located on the top of the soundboard by a nut (e.g., a grooved member placed laterally across the neck at its end) and a saddle/bridge combination (e.g., at the sound box end) to lift the strings up and away in a parallel manner from the top of the sound box. When plucked, the musical strings may produce a sustaining signal of vibration-based pulses that may be transmitted to the guitar's soundboard and neck by the nut, saddle, and bridge. Only a small fraction of the string's energy leaves directly as sound. The pulses sent into the soundboard cause a complex vibration of the sound box's structure to create most of audible tones for the guitar during playing while a series of rapid pressure fluctuations occurring at the sound hole creates a smaller set of audible signals.

During the playing of the guitar, the striking or plucking of the strings may be accomplished by direct string contact, generally over the sound hole, with the players' finger tips or a plectrum (e.g., pick) held in the player's fingers. Because of the close proximity of the strings to the soundboard and sound hole, while the player is generally strumming (moving one of its hands up and down over the strings), the player may contact the lower edges of the sound hole with its fingers or the pick while striking the strings in a downward motion. The material (e.g., wood and any protective treatment) composing the top of the sound box and a lower portion of the sound hole edge (as well as that area directly located below the sound hole) may be susceptible to damage due to this contact (especially from the pick contact or strike). Even when the guitar is just moderately played, such pick contact may damage the sound hole edge and it's surrounding area on the soundboard. Some of the damage that may occur include, but are not limited to; the marring/scratching of lacquer/resin finish of the guitar; exposing bare wood; chipping of wood (which may further result to cracking extending downward onto the soundboard) and the like. This damage may not only effect the resonance capability of the sound box (leading to the degradation of sound emissions) but may so serious impair or weaken the structure of the top of the sound box as to effectively prevent the playing of the guitar, thus leading to the guitar's replacement (which could cost several thousands of dollars).

There have been some attempts to limit such damage, but most these attempts appear to focus not on sound hole damage but rather soundboard top surface damage from pick contact. One such attempt could be a pick guard, generally seen as a plate or sheet of thin acrylic plastic or the like that is permanently applied to the top of the sound box proximate along the lower region of the sound hole. Although it may be applied post manufacture by guitar owners and users, guitar makers have also been applying the pick guard during guitar construction. Some limitations of this protection may occur, depending upon the manufacture of the guitar, wherein the pick guard placement on the guitar leaves an unprotected gap running concentric to the sound hole between the sound hole edge and the top of the pick guard.

What could be needed is a dedicated sound hole guard that can be applied during or post guitar manufacture that helps ameliorate or prevent the damage that can occur with pick-to-sound hole contact without substantially affecting the sound performance of the guitar. This guard could be definite length of resilient polymer, metal, or other mar resistant material substantially having at least an L-shaped or a U-shaped lateral cross section with an overall lunar shape (or could be bent to accommodate a curvature of a portion edge of the soundboard denoting the sound hole) wherein the guard is applied over the lower sound hole edge that denotes sound hole so that at least a portion of the edge is retained within the guard. Such a guard could be used to stabilize and possibly strengthen the soundboard top area that suffers pick strike damage to the extent of possibly restoring such damaged guitars to playing condition.

SUMMARY OF ONE EMBODIMENT OF THE INVENTION

Advantages of One or More Embodiments of the Present Invention

The various embodiments of the present invention may, but do not necessarily, achieve one or more of the following advantages:

to substantially reduce damage to sound hole edge and rosette of a soundboard of guitar by pick strikes during playing;

the ability to limit chipping and breaking of the guitar's soundboard due to pick strikes on the sound hole edge;

to substantially provide a sound hole guard that prevents pick strike damage to the sound hole edge and soundboard exterior surface with out affecting the sound performance of the guitar;

the ability to reinforce, either during manufacture or post-manufacture of a guitar of at least a portion of the sound hole edge;

to substantially provide a guard that could strengthen pick strike damaged area of a guitar to return the guitar to playing condition; and the ability to generally limit or stabilize existing damage to sound hole edged caused by pick strikes.

These and other advantages may be realized by reference to the remaining portions of the specification, claims, and abstract.

Brief Description of One Embodiment of the Present Invention

A guitar sound hole guard comprising of a body of a suitable durable material to resist pick impacts, the body being of definite length, having a lip and at least one flange; the lip further having two side edges; one flange connects to a respective side edge to be oriented perpendicular to the lip and descending away from the lip, an open channel being formed by the lip and flange; an attachment means to hold the guard in place upon a soundboard of a guitar, wherein the body receives within its open channel at least a portion of a lower sound hole edge of the soundboard allowing the lip to rest upon and conform concentrically to the lower portion of the sound hole edge.

Another possible embodiment of the invention could be a methodology of applying a sound hole guard to a guitar comprising the following steps but not necessarily in the order shown providing a guitar having at least a sound box, the sound box having at least a soundboard, the soundboard having two sides, an inner side and an external side connected to each other by a sound hole denoted by sound hole edge in the soundboard; providing a sound hole guard having a lip connected to at least one flange forming an open channel, the guard further having attachment means for securing the guard to the soundboard; applying the guard to the soundboard so that open channel receives at least a lower portion of the sound hole edge; and contacting the attachment means to at least one side of the soundboard.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
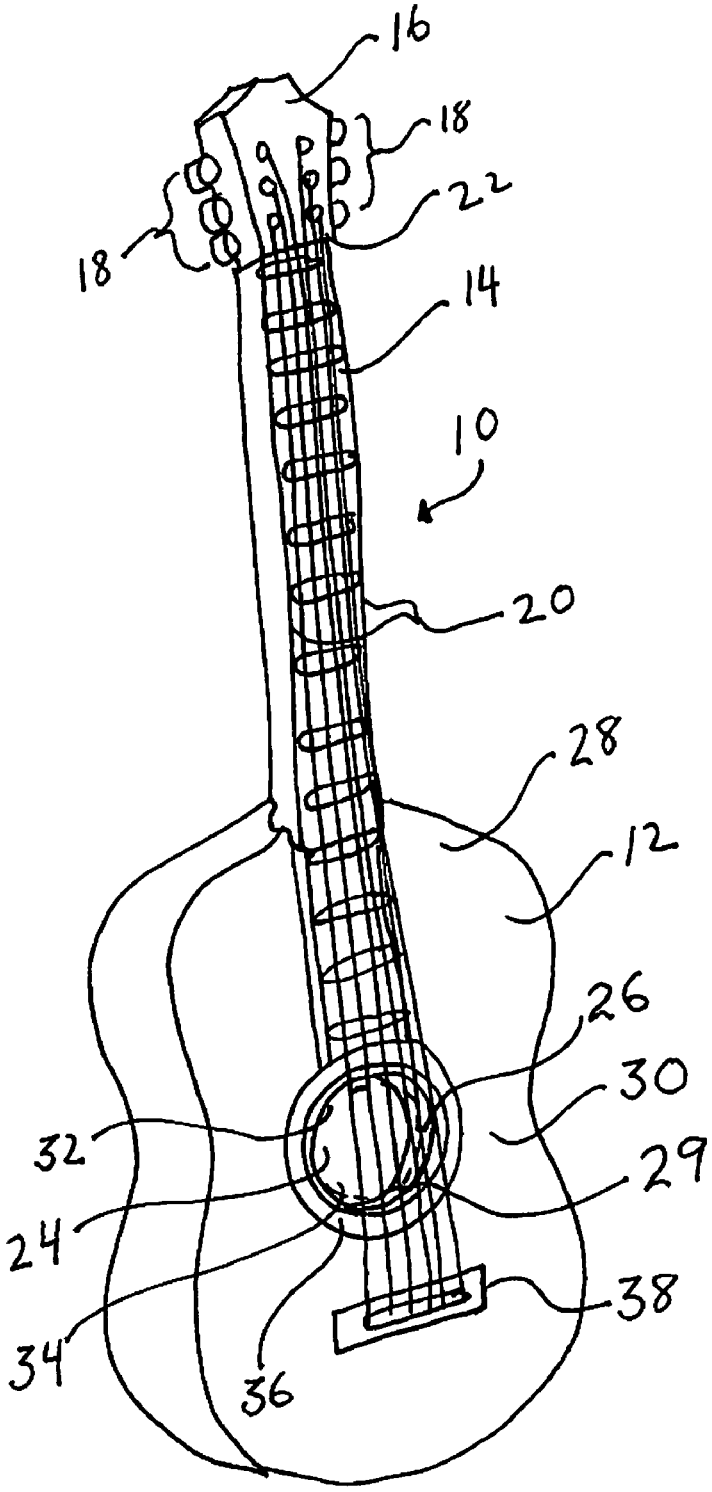
FIG. 1 is substantially a cutaway perspective view of guitar.

As substantially shown in FIG. 1, the guitar 10 could be constructed of a neck 14 connected to one end of soundboard 12 (e.g., a resonance box.) The head of the neck (or head stock 16) could feature a set of tuning keys 18 that are used to movably attach and tension a plurality of playing strings 20 to the neck 14. A nut 22 (e.g., a grooved rectangular piece of wood) laterally straddles the neck 14 by the head stock 16 to generally lift the strings 20 off the neck 14, as well as the soundboard 12. The strings 20 could then travel longitudinally down from the top of the neck 14 and up over an exterior side 30 of a top 28 of soundboard 12. The strings 20 could pass over a sound hole 24 (e.g., a round hole in the soundboard 12) as denoted by a circumference 29 of a sound hole edge 26 of the soundboard 12 to the saddle/bridge combination 38, which then generally brings the strings 20 to contact with the exterior side 30 of the soundboard top 28. The top 28 could also feature an interior side 32, which generally presents into a hollow interior 34 of the soundboard 12.

Generally, the lower portion (e.g., pick strike area) of the sound hole edge 26 (e.g., so located when the guitar 10 is held in a generally horizontal position during play) suffers the most damage due to the repeated down stroke contact of pick (not shown). This action can result in the chipping of soundboard material as well as its protective coatings, and in the case of wood-based soundboards 12, may further result in occurrences of splintering and cracking of the top 28 proximate to the sound hole edge 26. In many cases, the rosette 36 (e.g., a decorative circular design around the parameter of the sound hole 24), which may be constructed with inlaid wood, may also be damaged by pick strikes hitting or hitting proximate to the sound hole edge 26.

It should be noted that the guitars 10 can be constructed to have certain playing orientations (e.g., a left-handed guitar vs. a right-handed guitar) to allow a player to operate/strum the instrument with their dominate hand. Although the overall structure of guitar 10 is generally that of bilateral symmetry, substantially allowing the guitar 10 to be flipped over for orientation of right hand/left hand operation, the right hand/left hand guitars 10 substantially have specific construction to their operational orientation (e.g., left handed/right handed guitars have different nuts 22 and hence string arrangements, wherein the heavier string 20 is respectively located at the top of the nut 22 down to the lightest string 20 being at the bottom of the nut 22.) This playing orientation between such guitars 10 also results in the pick strike area (e.g., the lower portion) for the sound hole edge 26 for the right-handed guitar to be in the opposite position for that of left-handed guitar, thereby dictating the placement of the invention 40 upon right-handed/left-handed guitars.

Figure 2:
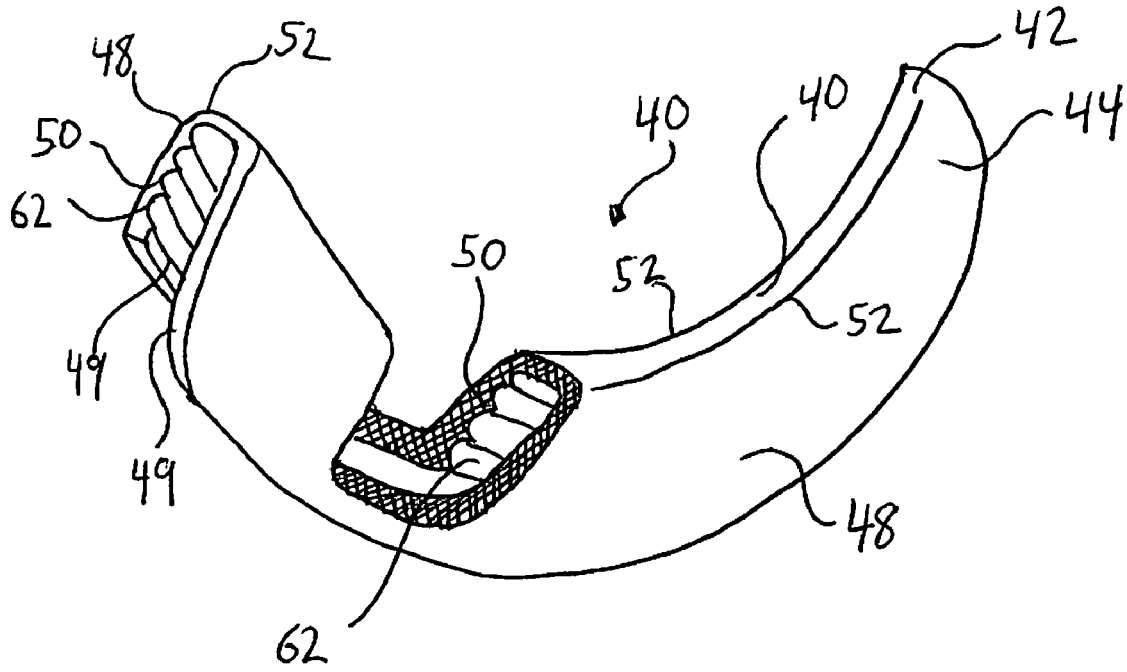
FIG. 2 is substantially a cutaway perspective view of one embodiment of the invention.
Figure 3:
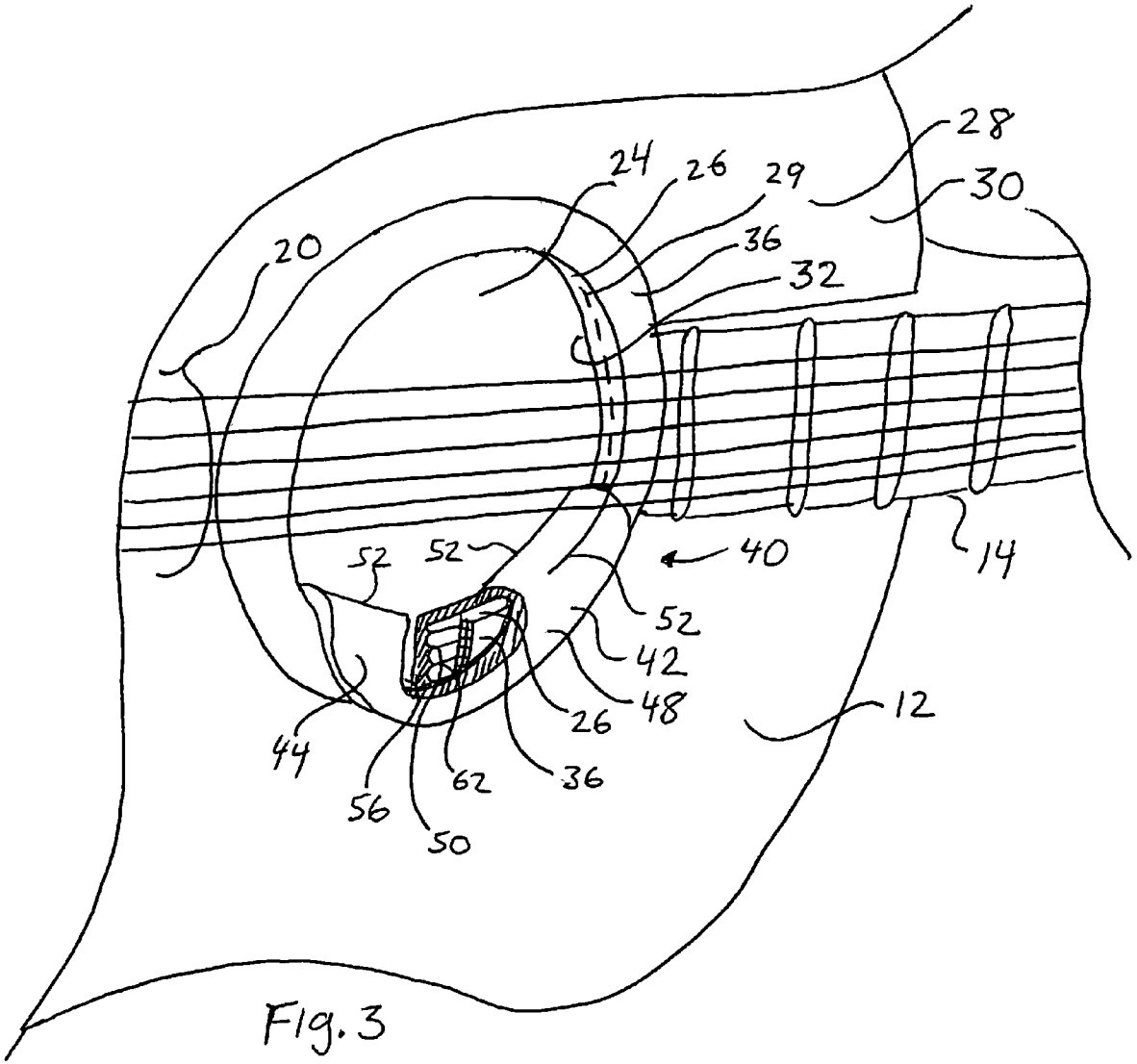
FIG. 3 is substantially a cutaway perspective view of one embodiment of the invention as applied to a guitar.
Figure 4:
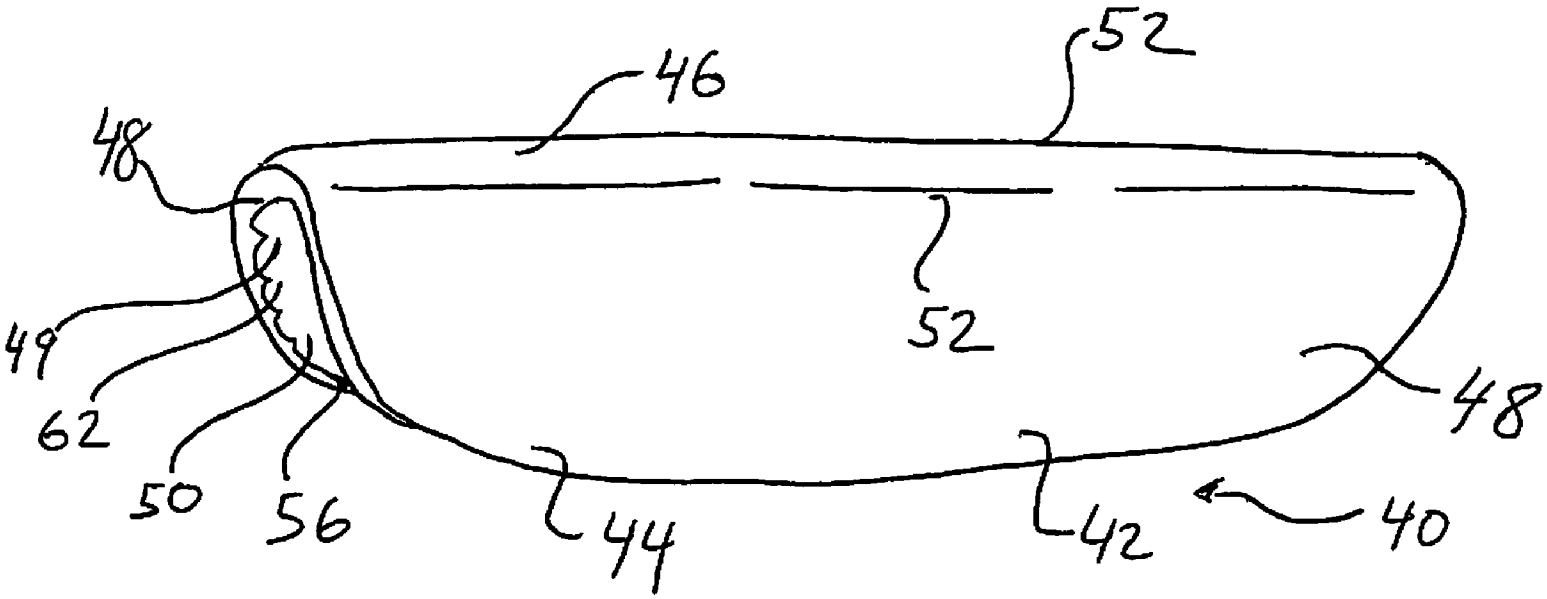
FIG. 4 is substantially a perspective view of a flexible linearly oriented embodiment of the invention.

As substantially shown in FIGS. 2, 3, and 4, the invention 40 could be a sound hole guard 42 to protect the lower portion sound hole edge 26 from down stroke pick contact damage and a methodology 200 of applying the guard 42 to a top 28 of a soundboard 12. The guard 42 could comprise of a body 44 having a lip 46, at least one flange 48 attached to the lip 46, and an attachment means 50 for affixing the guard 42 to the soundboard top 28. The lip 46 could be rectangular-shaped with two longitudinal or side edges 52. The flange 48 could have a substantially rectangular shape and be generally continuously connected to the lip 46 along a respected side edge 52. The combination of the lip 46 and the flange(s) 48 generally denoting an open channel 56 to substantially receive a lower portion of the sound hole edge 26.

If invention 40 is interpreted to generally have the guard 42 comprised of the lip 46 and two flanges 48, each flange could be continuously attached to a respective side edge 52 of the lip in a manner that allows the guard to substantially have a U-shaped lateral cross section 58. The U-shaped lateral cross section 58 may further denote the open channel 56 into which the guard 42 may accept a portion (e.g., lower) of the sound hole edge 26.

Figure 5:
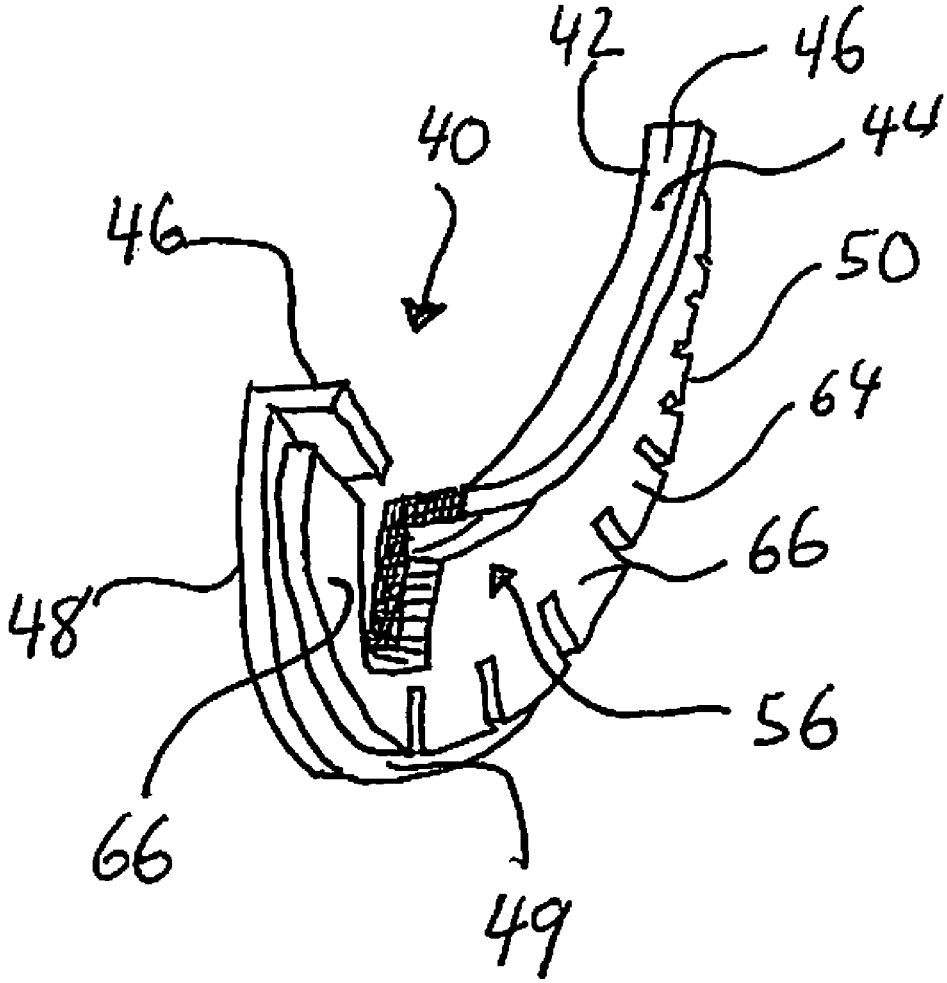
FIG. 5 is substantially a cutaway perspective view of another embodiment of the invention.
Figure 6:
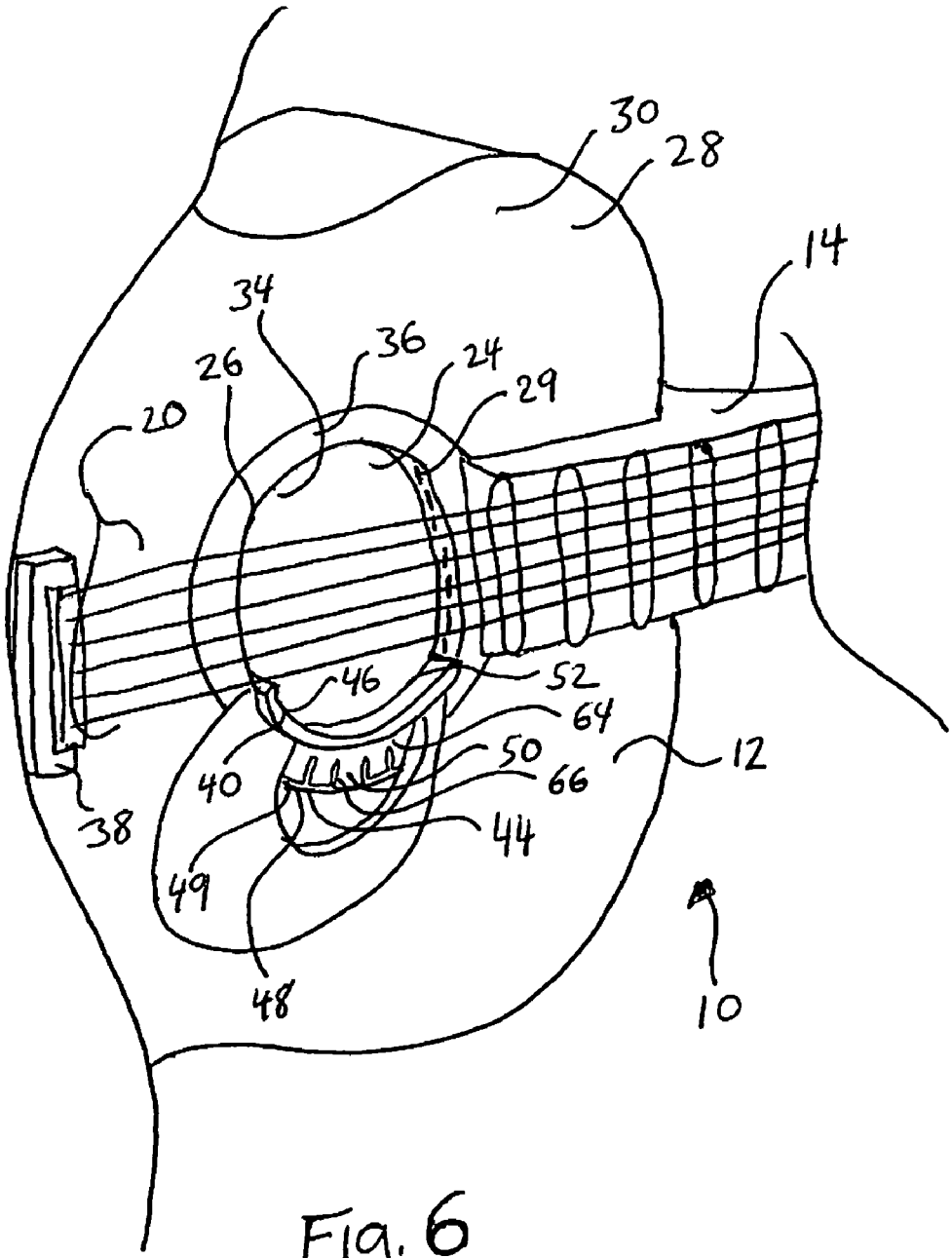
FIG. 6 is substantially a cutaway perspective view of another embodiment of the invention as applied a guitar.

As substantially shown in FIGS. 5 and 6, if the invention 40 were to be built with one flange 48, the flange 48 being attached to a respective side edge 52 of the lip 46, the guard 42 could have a L-shaped lateral cross section 54 that could substantially define the open channel 56 into which the guard 42 could accept a lower portion of the sound hole edge 26.

In one version, the invention 40 could be made to have a lunar or arcuate shape that generally matches a portion (e.g. lower portion) of the circumference 29 the sound hole edge 26, while another version of the invention 40 could be constructed in a more linear fashion with a flexible quality that allows it to assume a lunar or arcuate orientation when the guard 42 is placed upon a portion (e.g., lower) of the sound hole edge 26. To meet these requirements, the invention 40 could be made from a suitable durable material (e.g., polytetrafluoroethylene (PTFE), hard styrene plastic, aluminum, and the like), as known to those who have skill in the art to resist impact strikes of the pick and protect a lower portion of the sound hole edge 26. Additionally, the guard's material(s) could selected, in addition to have pick strike resistance capability, to have additional flexible characteristic(s) (e.g., using materials such as pliable polymers, rubber, and like) that could allow the invention 40 to normally be made with a straight linear shape that substantially assumes an arcuate shape to generally match the sound hole edge curvature or circumference 29 upon the general placement of the guard 42 upon the sound hole edge 26 to be protected, strengthened, conserved, and the like.

In either the singular or plural flange 48 versions of the invention 40, the guard 42 could have an attachment means 50 for securing and holding in place the guard 42 upon the desired portion of the sound hole edge 26 and portions of top 28 surrounding the sound hole edge 26. For the multi-flange version of the invention 40, the attachment means 50 could be built into the structure of the guard 42 itself.

One example of the attachment means 50 could include the function of having flanges 48 being biased together. In their normal state, the flanges 48 (and lip 46) could denote the open channel 56 whose width is narrower than the width of the top 28 of the soundboard 12. When the lower portion of the sound hole edge 26/top 28 is substantially inserted between the flanges 48, pushing the flanges 48 out of their resting state, their constructed bias could cause the flanges 48 to exert a retaining force upon the top 28/sound hole edge 26 placed within the open channel 56.

In another version of the attachment means 50, the guard 42 could be built with material (e.g., aluminum, etc) wherein after the portion of lower sound hole edge 26/area of the top 28 surrounding the edge 26 is generally inserted into the open channel 56, the flanges 48 could then be squeezed (or biased) together onto those areas of the top 28 to retain those areas within the open channel 56.

With either pre-application or post-application biasing of the flanges 48, the inner side 49 (e.g., those side[s] generally denoting the open channel itself) of one or more flanges 48 in such a case could also feature a roughen surface (e.g., serrations; a plurality of ridges 62 longitudinally located in a parallel orientation; or the like) to increase the frictional retention capability of the attachment means 50.

Figure 7:
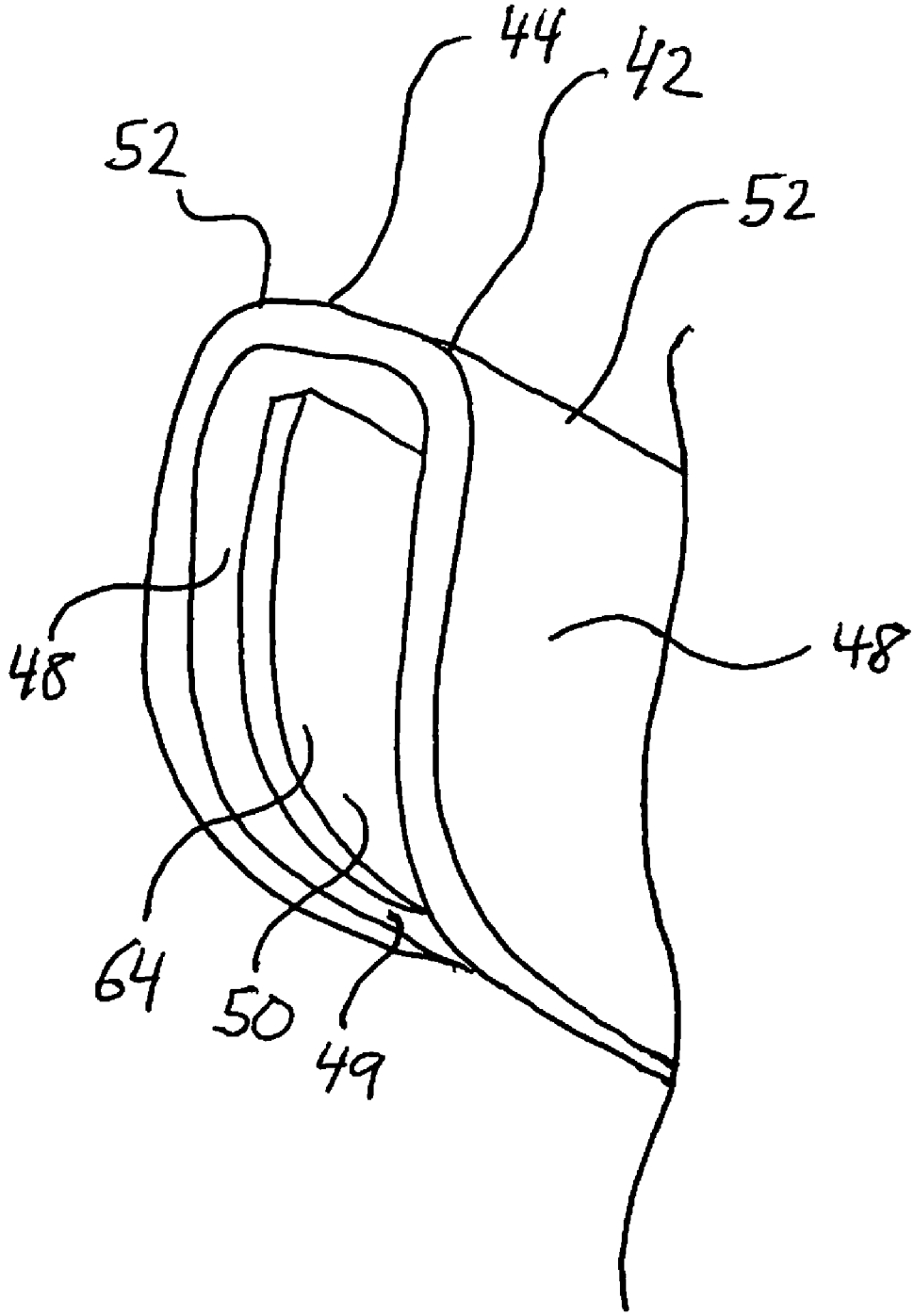
FIG. 7 is substantially a perspective view of an embodiment of the invention utilizing adhesive as an attachment means.
Figure 8:
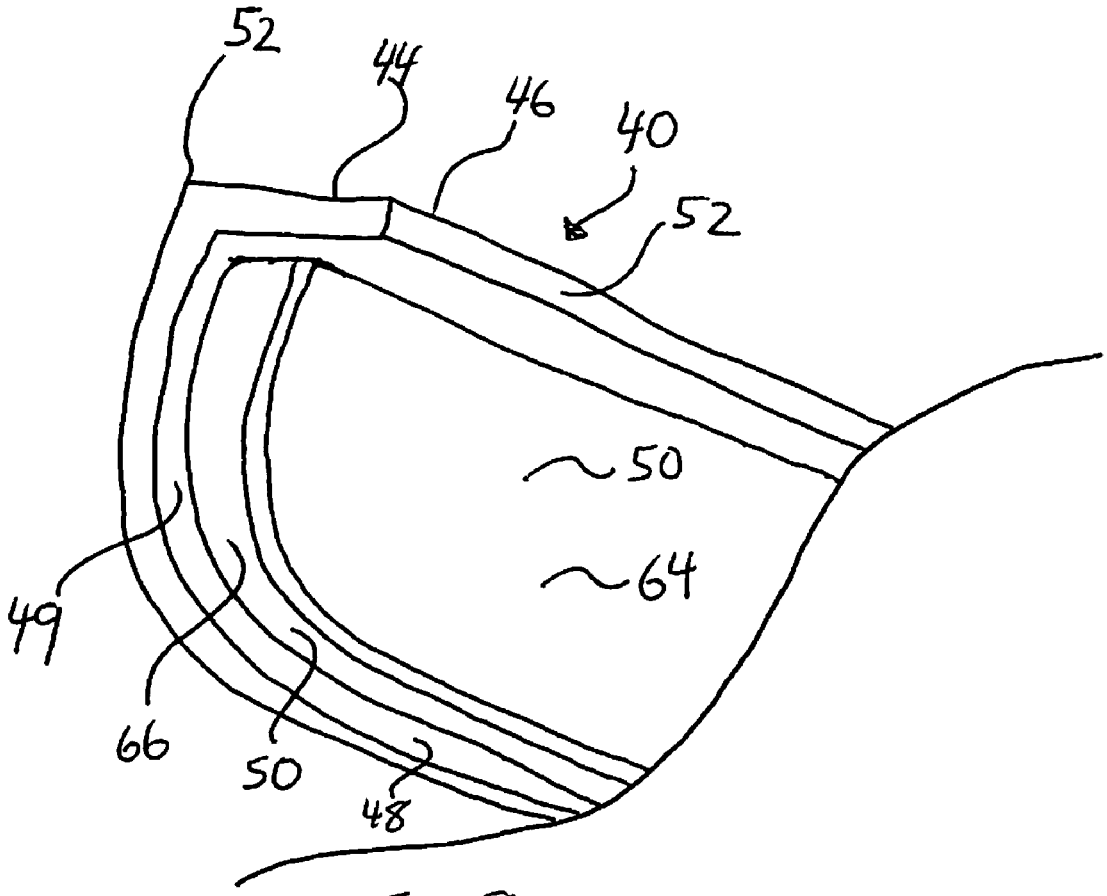
FIG. 8 is substantially a perspective view of an embodiment of the invention utilizing an adhesive pad as an attachment means.

As substantially shown in FIGS. 7 and 8, in both singular and plural flange embodiments of the guard 42, the attachment means 50 could be comprised of the inner side 49 of one or more flange(s) 48 bearing a suitable adhesive 64 such as a pressure self-adhesive (or PSA) as selected by those who have skill in the art. In such matters, the PSA could be directly applied to inner side 49, and then covered with a removable protective sheet. When the guard 42 is ready to be put in place on the lower portion of the sound hole edge 26/surrounding areas of the top 28, the protective sheet could be removed to expose the adhesive 64 to the side(s) of the top 28.

In yet other versions of the attachment means 50, the adhesive 64 could be applied using a pad 66 (e.g., fiber-based) having adhesive 64 on both sides of the pad 66. The pad 66 could be attached to the inner side 49 during manufacture or later during use. If applied during manufacture, then an exposed adhesive side of the pad 66 could be applied to inner side 49 of the flange 48 to secure the pad 66 to the flange 48 while the remaining side of the pad 66 could have a removable protective covering over the adhesive 64 (the covering can be removed later, such as by the operator, to generally expose remaining adhesive side to the top 28 for guard application.) If the attachment means 50 is to be used during operations, the pad 66 could have removable protective coverings on both sides to allow the operator apply the pad 66 first to the flange 48, then apply the guard 48 to top 28. The pad 66 could also feature a set of lateral cuts to allow the shape of the pad 66 to be bent allowing the pad 66 to be applied to an arcuate-shaped flange 48, or allow the flange 48 and fitted pad 66 be bent to arcuate shape during the application of the flexible guard 42 to the top 28.

Methodology

Figure 9:
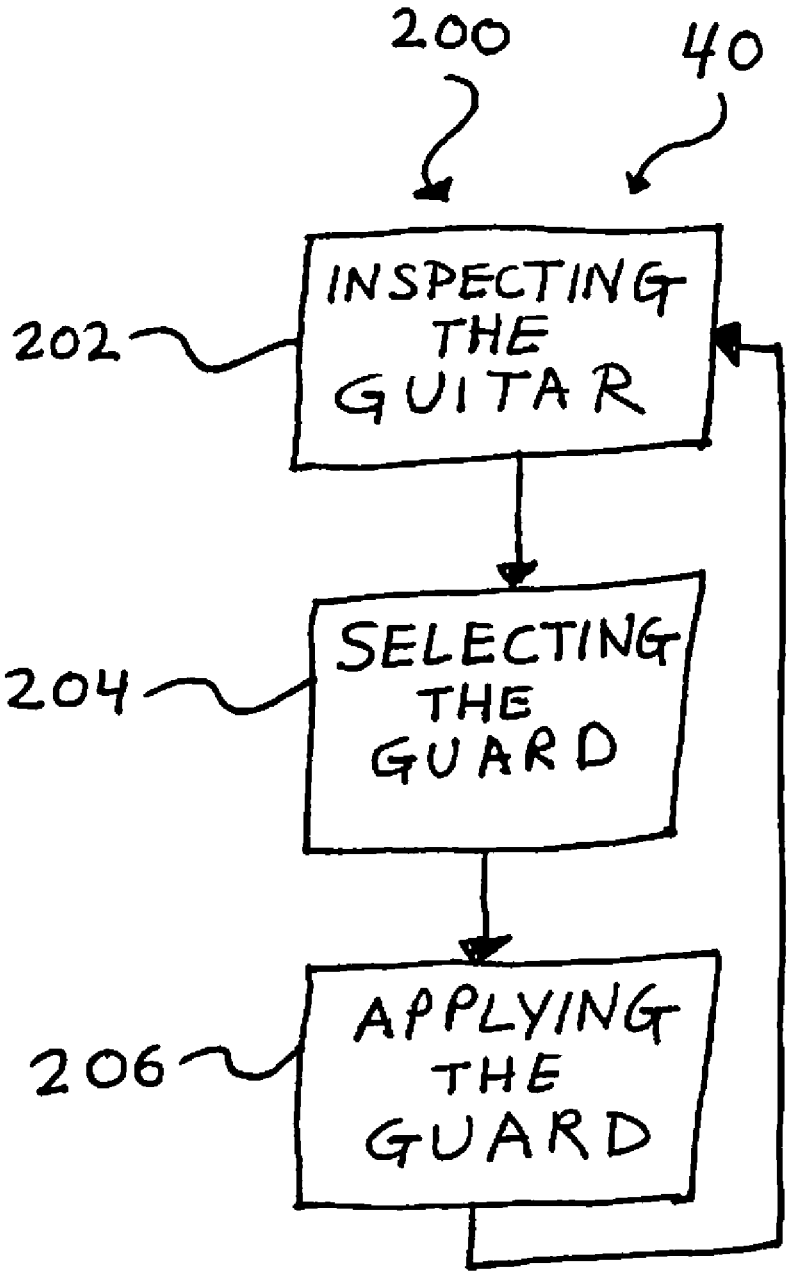
FIG. 9 is substantially a flow chart for a methodology of applying the invention to a guitar.

As substantially shown in FIG. 9, the process or methodology 200 of applying the sound hole guard to a guitar could start with step 202, inspecting the guitar. In this step, the operator could examine the guitar's sound hole edge (e.g., the lower section) and the top area proximate to the sound hole edge. The lower portion of the sound hole edge should be examined for pick strike impact damage (mashing, chipping, etc. of the edge) as well as to see if pick strikes on the edge have further lead to damage (e.g., splintering, chipping of protective finish, breaking off of material, etc) to the area of the top proximate to the lower portion. Although the guard is generally seen as a preventative device to prevent damage to a covered area, it could also be seen as a strengthening/stabilizing means for a covered area that has already suffered pick strike damage. In such cases, the application of the guard, in addition to preventing further damage, could possibly increase the structure strength of the damage area (e.g., to the point of restoring lost structure capacity due to pick strike damage.) The invention, in more severe pick strike damage cases, could possibly allow the instrument, previously unplayable due to pick strike damage, to be returned to service and be played again. Once this step is substantially completed, then the process 200 could proceed to step 204, selecting the guard.

In step 204, selecting the guard, if the examined area is undamaged (e.g., new or lightly played instrument) or relatively undamaged then the operator may wish to apply the one flange or L-shaped lateral cross-section version of the guard, especially if the guitar has a pick guard in place. If the guitar lacks a pick guard and/or may have significant damage to the lower sound hole edge then the operator may want to apply the multi-flange (e.g., U-shaped lateral cross-section version) of the sound hole guard either just to further protect the top area proximate to the lower sound hole edge and/or reinforce/stabilize that top area if it was structurally compromised (e.g., chipping, splintering, and the like) from damage to the sound hole edge. Once step 204 is generally completed, the process 200 can proceed to step 206, applying the guard.

At step 206, applying the guard, the operator prepares the selected guard for placement on the desired area of the guard. Depending on the application, the operator may manipulate the guard to ensure proper setup of the attachment means. This could include removing protective covering from the adhesive pad, possible moving biased flanges apart slightly; and the like. The operator could then place guard upon the top so that the damaged sound hole edge or edge to be protected is substantially located within the open channel. At this time the procedure 200 could be substantially completed and the musical instrument could be ready for use. In some versions of the invention, the attachment means (e.g., manually biasing the flanges) is activated after placement of the guard upon the top occurs.

With the guard in place, the protected instrument is ready to be played. For application of a new guard to another musical instrument, the process could revert to step 204.

Conclusion

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the example.

As substantially described and claimed, the invention has the ability to generally reduce damage to sound hole edge and rosette of a soundboard of guitar by pick strike contact in those areas. In certain cases, the invention may further strengthen those areas to allow a previously damaged, unplayable instrument to be restored to operational condition. The invention could also provide a sound hole guard whose application to a guitar does not substantially affect the sound performance or the playing of the guitar.

What is claimed is:

1. A sound hole guard for a guitar comprising of :

(A) a body of a durable material sufficient to resist damage by pick impact, the body being of definite length, having a lip and at least one flange;

(B) the lip further having two side edges;

(C) each flange connects to a respective side edge to be oriented perpendicular to the lip and descending away from the lip;

(D) an open channel being formed by the lip and flange;

(E) an attachment means to hold the guard in place upon a soundboard of a guitar;

wherein the body receives within its open channel a lower portion of a sound hole edge of the soundboard allowing the lip to rest upon and conforms concentrically to a portion of the circumference of the sound hole edge.

2. The sound hole guard of claim 1 wherein the lip conforms concentrically to the portion of the circumference of the sound hole only after the guard is applied to the guitar.

3. The sound hole guard of claim 1 wherein lip conforms concentrically to the portion of the circumference of the sound hole edge prior to the guard being applied to the guitar.

4. The sound hole guard of claim 1 wherein the body has an arcuate shape.

5. The sound hole guard of claim 1 wherein the body has a L-shaped cross section.

6. The sound hole guard of claim 1 wherein the at least one flange rests against the internal side of the soundboard to which the guard is applied.

7. The sound hole guard of claim 6 wherein the attachment means comprises of at least one flange with a side supporting self-adhesive in such a manner that allows the self-adhesive to come in contact with the internal side of a soundboard.

8. The sound hole guard of claim 1 wherein there are at least two flanges, an inner flange to rest against the inner side of the soundboard and an external flange to rest against the outer side of the soundboard.

9. The sound hole guard of claim 8 wherein the attachment means comprises of having the flanges being biased towards one another.

10. The sound hole guard of claim 9 wherein the flanges are biased only after the guard has been placed on the soundboard.

11. The sound hole guard of claim 8 wherein the attachment means comprises of at least one flange having a side with a rough surface that side faces another flange.

12. The sound hole guard of claim 11 wherein the rough surface is a plurality of ridges longitudinally located in a parallel orientation.

13. The sound hole guard of claim 8 wherein one flange has a inner side presenting an adhesive in such a manner that allows the adhesive to come into contact with a side of the soundboard.

14. The sound hole guard of claim 8 wherein the body has a U-shaped lateral cross section.

15. A methodology of applying a sound hole guard to a guitar comprising the following steps but not necessarily in the order shown:

(A) providing a guitar having at least a sound box, the sound box having at least a soundboard, the soundboard having two sides, an inner side and an external side connected to each other by a sound hole denoted by a sound hole edge in the soundboard;

(B) providing a sound hole guard having a lip connected to at least one flange forming an open channel to receive at least a portion of the sound hole edge, the guard further having attachment means for securing the guard to the soundboard;

(C) applying the guard to the soundboard so that open channel receives a lower portion of the sound hole edge; and (D) contacting the attachment means to at least one side of the soundboard.

16. The methodology of claim 15 wherein the applying the guard further comprises the step of contacting a flange to a respective side of the soundboard and the step of conforming the lip to a portion of a circumference of the sound hole edge.

17. The methodology of claim 15 wherein the applying a sound hole guard further comprises the step of fitting the guard to concentrically rest against the lower portion of the sound hole edge so that the guard acquires an arcuate shape.

18. The methodology of claim 15 wherein the guard comprises of two flanges, the lip as connected to the flanges gives the guard a U-shaped lateral cross section.

19. The methodology of claim 15 wherein the guard has an arcuate shape.

20. The methodology of claim 15 wherein the applying the guard further includes the step of strengthening a pick strike damaged soundboard, the damage of the soundboard originating from the sound hole edge.

* * * * *